US009150395B2

(12) United States Patent
Kritzer

(10) Patent No.: US 9,150,395 B2
(45) Date of Patent: Oct. 6, 2015

(54) PORTABLE TWO POST AUTOMOBILE LIFT

(75) Inventor: Jeffrey Scott Kritzer, Moorpark, CA (US)

(73) Assignee: HENTHORN INTELLECTUAL PROPERTIES HOLDINGS, INC., Moorpark, CA (US)

( * ) Notice: Subject to any disclaimer, the term of this patent is extended or adjusted under 35 U.S.C. 154(b) by 444 days.

(21) Appl. No.: 13/602,288

(22) Filed: Sep. 3, 2012

(65) Prior Publication Data

US 2013/0233651 A1 Sep. 12, 2013

Related U.S. Application Data

(63) Continuation-in-part of application No. 12/263,066, filed on Oct. 31, 2008, now Pat. No. 8,256,577.

(51) Int. Cl.
*B66F 7/28* (2006.01)
*B66F 3/46* (2006.01)
*B66F 7/20* (2006.01)

(52) U.S. Cl.
CPC ... *B66F 7/28* (2013.01); *B66F 3/46* (2013.01); *B66F 7/20* (2013.01)

(58) Field of Classification Search
CPC ..... B66F 7/04; B66F 7/28; B66F 7/20
USPC ..... 187/203–221
See application file for complete search history.

(56) References Cited

U.S. PATENT DOCUMENTS 2,099,636 A 11/1937 Weaver
2,867,409 A 1/1959 Southerwick
2,915,143 A 12/1959 Simmons, Sr.
3,271,006 A 9/1966 Brown et al.
3,405,781 A 10/1968 Brown
4,599,034 A * 7/1986 Kennedy et al. ..... 414/678
4,825,977 A * 5/1989 Isogai ..... 187/206
5,009,287 A 4/1991 Starr
5,236,065 A 8/1993 Isogai
5,318,154 A 6/1994 Hellman, Jr. et al.
5,358,217 A 10/1994 Dach
5,411,234 A 5/1995 Schoeller
5,484,134 A 1/1996 Francis
5,803,206 A * 9/1998 Halstead et al. ..... 187/208

(Continued)

FOREIGN PATENT DOCUMENTS

CA 564118 9/1958

*Primary Examiner* — Michael Mansen
*Assistant Examiner* — Michael Riegelman
(74) *Attorney, Agent, or Firm* — Erickson Kernell Derusseau & Kleypas, LLC

(57) ABSTRACT

A portable automobile lift includes a plurality of portable lifting columns and a portable power unit. Each lifting column includes a column base, a post extending upwardly from the column base, a lifting carriage moveably mounted on a forward side of the post, and a hydraulic actuator connected to the lifting carriage for movement of the lifting carriage along the post. Each column base comprises a respective base plate connected to a lower end of the respective post. The base plate anchor bolt receiving holes extending therethrough for receiving respective anchor bolts. Each column base further includes a pair of wheels positioned to engage a ground surface rearward of the base plate for ease of portability of the columns. The lift also includes a safety lock assembly that automatically engages during upward movement of the lift to prevent unintentional lowering or falling of the lifting carriage.

12 Claims, 8 Drawing Sheets

(56) References Cited

U.S. PATENT DOCUMENTS

| | | | | |
|---|---|---|---|---|
| 5,911,408 | A | 6/1999 | Berends et al. | |
| 5,954,160 | A | 9/1999 | Wells, Sr. et al. | |
| 6,273,215 | B1 | 8/2001 | Horan et al. | |
| 6,279,685 | B1 | 8/2001 | Kogan et al. | |
| 6,382,358 | B1 * | 5/2002 | Kritzer | 187/208 |
| 6,505,815 | B1 | 1/2003 | Dellamore | |
| 6,845,848 | B1 | 1/2005 | Kritzer | |
| 7,014,012 | B2 | 3/2006 | Baker | |
| 2003/0121726 | A1 | 7/2003 | Berends | |
| 2005/0067227 | A1 | 3/2005 | Wengelski et al. | |

* cited by examiner

PORTABLE TWO POST AUTOMOBILE LIFT

CROSS-REFERENCE TO RELATED APPLICATIONS

This application is a continuation-in-part of U.S. Pat. No. 8,256,577 filed Oct. 31, 2008 and issued Sep. 4, 2012, the disclosure of which is hereby incorporated herein in its entirety by reference.

BACKGROUND

This invention relates to automobile service lifts, and in particular to a two post lift having portable lifting columns that can be easily moved into position and bolted down for use and then unbolted and removed for storage.

A wide variety of post-type automobile lifts have been previously known and used in the automobile repair business and by hobbyists to provide access to the underside of a vehicle. Post lifts can be either of the in-ground or above-ground variety. In-ground post lifts usually have one or two vertically ascending columns mounted below the floor of a garage or service area that are raised hydraulically to lift the vehicle. Above-ground post lifts generally have two or four vertical columns or "posts," each of that includes a carriage that rides up and down the post. The carriages each include outwardly extending outriggers or arms that engage the undercarriage of a vehicle to be lifted. Traditionally, these posts have been permanently installed in a fixed position.

Portable above-ground post lifts are also known in the prior art. These prior art lifts include portable lifting columns having wheels for moving them from place to place. In order to stabilize the lifting columns while in use, the lifting columns generally include large bases having forwardly extending legs. These legs serve to keep the columns from tipping forwardly when a load is applied to the arms. While the legs are effective in preventing tipping of the lifting columns, they make the lifting columns more difficult to transport and substantially increase the amount of space needed to store them when not in use. It would, therefore, be desirable to produce a portable lift having a smaller base to facilitate easy transport and storage of the lifting columns.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter.

In brief, this disclosure describes, among other things, a portable two-post lift having column bases that do not include outwardly extending legs. Instead, the bases each comprise a base plate connected to a lower end of the post. Each base plate has one or more edges that are spaced outwardly from the respective walls of the post to form mounting flanges. The mounting flanges have anchor bolt receiving holes extending therethrough, allowing the lifting columns to be temporarily bolted to a slab when in use. The column bases each further include a pair of wheels positioned to engage a ground surface rearward of the base plate.

When the lift is in use, anchor bolts are inserted through the anchor bolt receiving holes and tightened into anchors permanently installed in a concrete slab. When the lift is not in use, the anchor bolts may be removed to disconnect the column bases from the slab. The columns may then be tilted back onto their wheels and rolled to a storage location. Because the base plates are relatively small, the amount of storage space required for the lift is substantially less than for a comparable lift with outwardly extending legs.

The lift further includes a portable power unit for powering the lifting columns. The power unit includes a hydraulic pump, motor, and reservoir mounted on a cart for easy transport and storage. A rotary gear flow divider is also mounted on the cart and divides flow of hydraulic fluid between the lifting columns.

DESCRIPTION OF THE DRAWINGS

Illustrative embodiments of the invention are described in detail below with reference to the attached drawing figures, and wherein.

DETAILED DESCRIPTION

Figure 1:
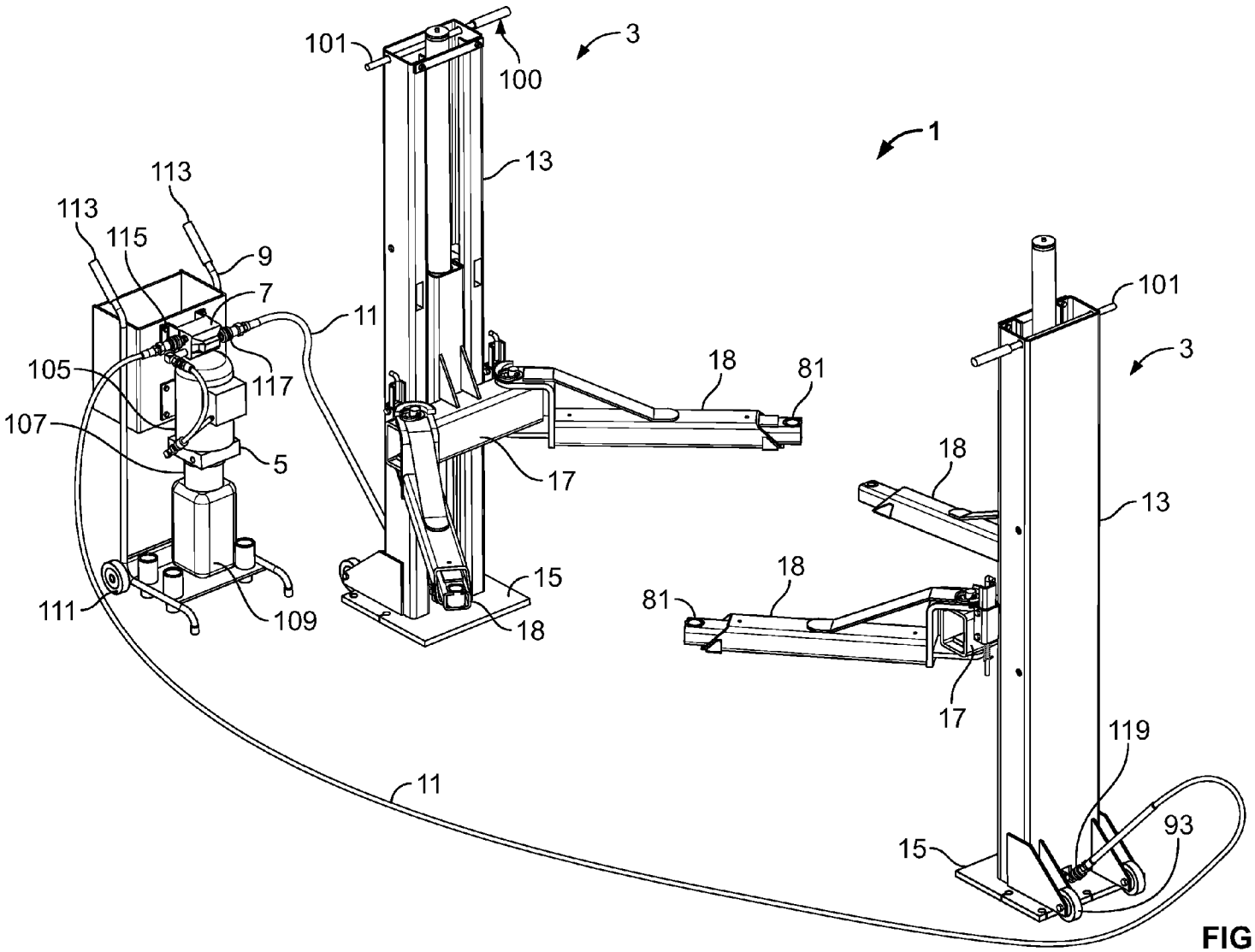
FIG. 1 is a perspective view of a portable two post automobile lift depicted in accordance with an embodiment of the invention.
Figure 2:
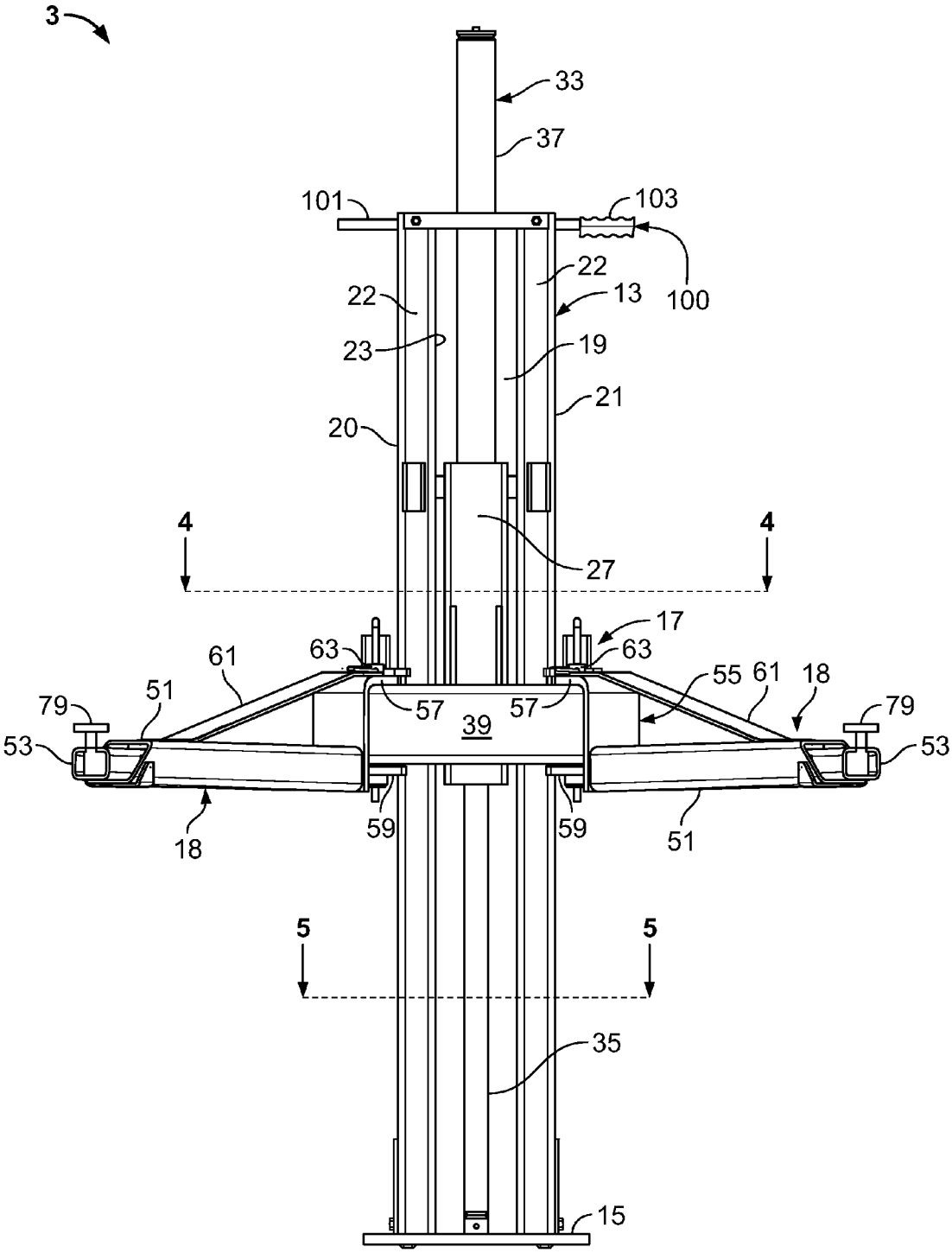
FIG. 2 is a front elevational view of one lifting column of the automobile lift of FIG. 1.
Figure 3:
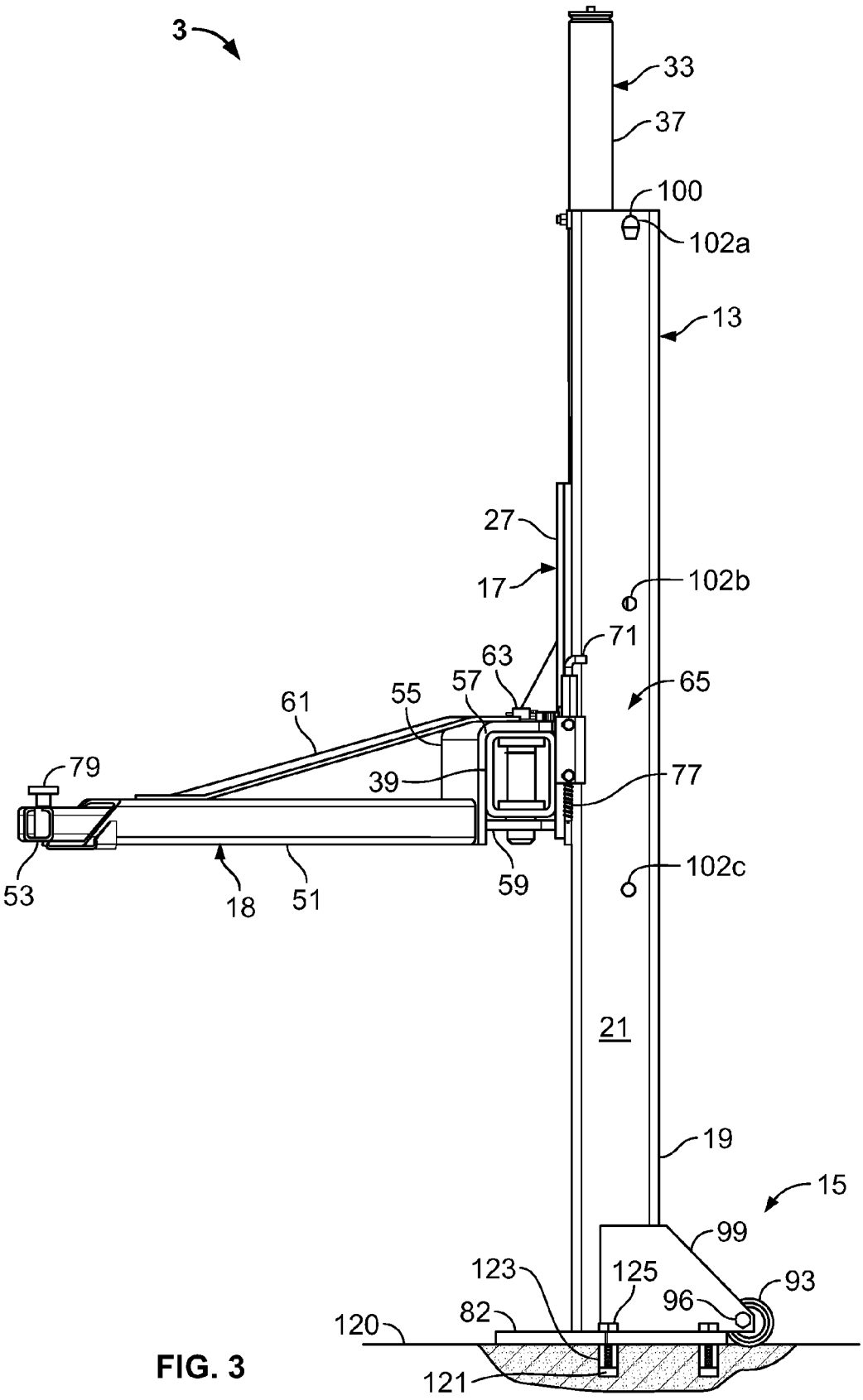
FIG. 3 is a side elevational view of the lifting column of FIG. 2.
Figure 4:
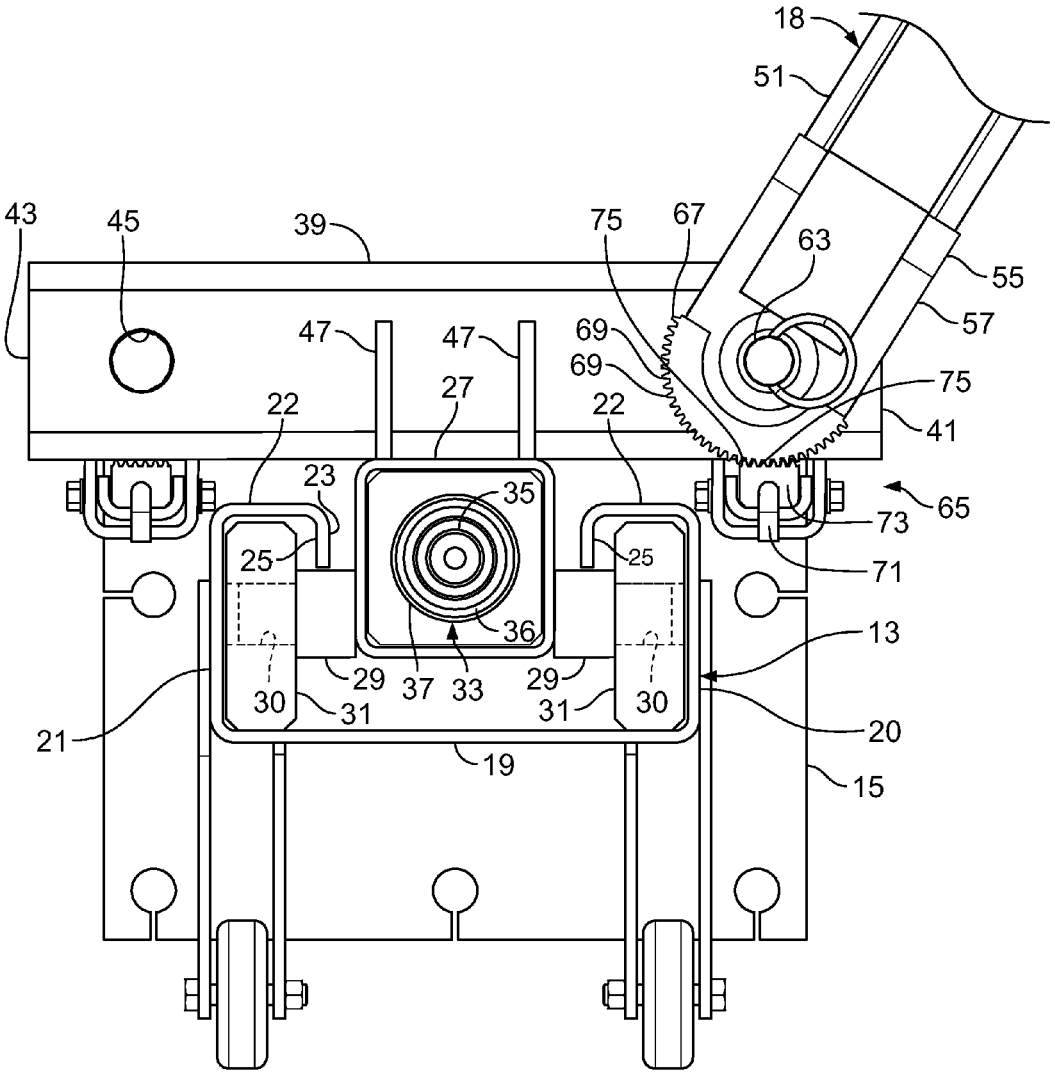
FIG. 4. is a fragmentary cross-sectional view of the lifting column taken generally along line 4-4 in FIG. 2 and showing one arm thereof removed for clarity.
Figure 5:
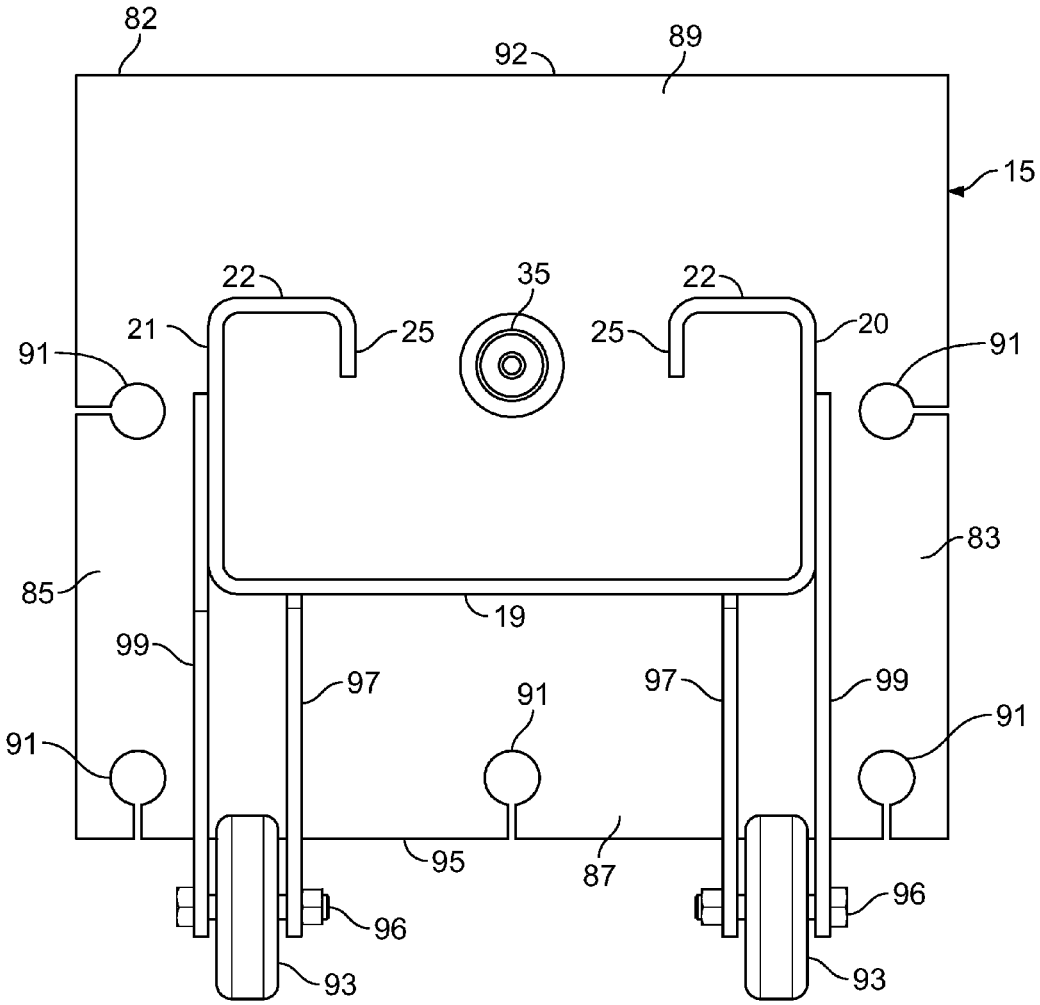
FIG. 5 is a cross-sectional view of the lifting column taken generally along line 5-5 in FIG. 2.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIG. 1, the reference number 1 generally designates a portable two-post lift according to the present invention. The lift 1 generally includes two portable lifting columns 3, a power unit 5 and flow divider 7 mounted on a cart 9, and a pair of quick-disconnect hoses 11. Each lifting column 3 includes a post 13 extending upwardly from a column base 15, and a lifting carriage 17 vertically moveable along the post 13. Mounted on each lifting carriage 17 and extending outwardly therefrom is a pair of arms 18 for engaging an undercarriage of a vehicle (not shown). The column bases 15 are adapted to be bolted to a ground surface, such as a concrete slab, when the lift 1 is in use, and to be unbolted from the ground surface when the lift is not in use so that the lifting columns 3 can be moved to storage.

Referring to FIGS. 2-5, the post 13 of each lifting column 3 is generally rectangular in cross section and includes a rear wall 19, and first and second sidewalls 20 and 21, respectively. The front of the post 13 includes a pair of narrow front flanges 22 that extend inwardly from the respective sidewall 20 or 21 and define a slot 23 between them. A respective edge flange 25 (see FIGS. 4 and 5) extends rearwardly from each of the front flanges 22 adjacent the slot 23.

The lifting carriage 17 of each lifting column 3 includes a carriage base 27, that generally comprises a vertical length of square tubing having a width sized to allow the carriage base 27 to extend through the slot 23 and into the post 13. Two pairs of stub axles 29 (see FIG. 4) extend outwardly from the carriage base 27 in opposed lateral directions. Each stub axle 29 is received in an opening 30 formed in a respective glide block 31. The glide blocks 31 are slidably received in the post 13 and are each captured front-to-rear between the rear wall 19 and a respective one of the front flanges 22. The glide blocks 31 are each also captured side-to-side between one of the sidewalls 20 or 21 and the respective edge flange 25. The carriage base 27 is vertically slidably moveable on the glide blocks 31 along the post 13.

Each lifting column 3 includes a respective hydraulic actuator 33 having a rod 35 connected to a piston 36 slidably received in a cylinder 37. A distal end of the rod 35 is connected to the column base 15 inside the post 13. The cylinder 37 is received inside and connected to the carriage base 27. Hydraulic pressure selectively acting on the piston will thus move the cylinder 37 and carriage base 27 upwardly relative to the column bases 15. Controlled release of pressure allows the carriage base 27 to move downwardly toward the column base 15.

The lifting carriage 17 further includes a crossbar 39 that comprises a length of square tubing secured to the front face of the carriage base 27 proximate a lower end thereof. The crossbar 39 is positioned transverse to the carriage base 27 outside the post 13 and includes opposed crossbar ends 41 and 43, spaced outwardly from the sidewalls 20 and 21 of the post 13, respectively. The crossbar 39 further includes a pair of vertical pin receivers 45 (see FIG. 4 in which one of the arms 18 has been removed), one proximate each of the crossbar ends 41 and 43. Gussets 47 are welded between the top face of the crossbar 39 and the front face of the carriage base 27 to reinforce the connection therebetween.

The arms 18 are mounted on the crossbar 39 by way of the pin receivers 45. Each arm 18 includes a proximate arm section 51 and a distal arm section 53 telescopically engaged with the respective proximate section 51. Both the proximate arm sections 51 and the distal arm sections 53 are shown as being formed of rectangular tubing, with the distal arm sections 53 being smaller in cross section and slidably received within the proximate arm sections 51. The proximate end of each proximate arm section 51 has a clevis 55 formed thereon for connection to the crossbar 39. Each clevis 55 includes an upper clevis plate 57 and a lower clevis plate 59. Each upper clevis plate 57 is spaced upwardly from the upper face of the respective proximate arm section 51, and a respective cross brace 61 extends between each upper clevis plate 57 and the upper face of the respective proximate arm section 51. A respective clevis pin 63 is simultaneously received through respective openings in the upper and lower clevis plates 57 and 59 of each clevis 55 and the respective pin receiver 45 to attach the arms 18 to the crossbar 39. The arms 18 may be easily removed for storage of the lift 1 by removing the clevis pins 63 and disconnecting the arms 18 from the crossbar 39.

The arms 48 are angularly adjustable relative to the crossbar 39 by rotation about the clevis pins 63. Arm restraints 65 are provided for selectively retaining each arm in a selected angular position. Each arm restraint 65 includes an arcuate rack member 67 mounted on a respective one of the proximate arm sections 51 concentric with the respective pin receiver 45. Each rack member 67 has teeth 69 formed on the outer edge thereof. Slidable latch bolts 71 are mounted on the crossbar 39 and include toothed latching members 73 having teeth 75 engageable with the teeth 69 of the rack members 67. The latch bolts 71 are vertically moveable between a lowered, latched position wherein the teeth 75 engage the teeth 69 and prevent the arms 48 from rotating about the clevis pins 63 and a raised, unlatched position wherein the arms 48 are freely rotatable about the clevis pins 63. Compression springs 77 bias the latch bolts 71 into the latched position. The latch bolts 71 extend downwardly a sufficient distance that, when the respective lifting carriage 17 is in its fully lowered position, the lower ends of the latch bolts 17 engage the column base 15, thereby compressing the springs 77 and releasing the latching members 73 from the rack members 67. This allows the arms 18 to be freely adjustable when the lifting carriages 17 are in their lowered positions.

Means for engaging the undercarriage of a vehicle (not shown), such as lifting pads 79 rotatably received in pad receivers 81, are provided on the distal arm sections 53 proximate the distal ends thereof.

Each column base 15 includes a base plate 82 having outer edges spaced outwardly from the sidewalls 20 and 21, rear wall 19 and front flanges 22 of the post 13, respectively, to form a first side mounting flange 83, a second side mounting flange 85, a rear mounting flange 87 and a front mounting flange 89. For purposes of this description, the rear mounting flange 87 will be considered to be the entire portion of the base plate 82 lying rearward of the rear wall 19 and the front mounting flange 89 will be considered to be the entire portion of the base plate 82 lying forward of the front flanges 22, with the side mounting flanges 83 and 85 lying therebetween and laterally outward from the respective sidewalls 20 and 21. It is to be understood, however, that the portions of the base plate 82 lying rearward of the rear wall 19 and forward of the front flanges 22 yet laterally outward from the sidewalls 20 and 21 could also be considered part of the side mounting flanges 83 and 85, respectively.

A plurality of anchor bolt receiving holes 91 are formed through the mounting flanges 83-89. As a vehicle is lifted by the respective lifting column 3, the weight of the vehicle is supported on the arms 18 forward of the column base 15, creating a load torque on the base plate 82 that acts to urge the base plate 82 upwardly at the rear mounting flange 87 and pivot about a front edge 92 of the front mounting flange 89. It is therefore preferred that the anchor bolt receiving holes 91 be concentrated along the rear mounting flange 87 and side mounting flanges 83 and 85 to resist this load torque.

The base plate 82 is thus shown as having three anchor bolt receiving holes 91 along the rear mounting flange 87 with one additional bolt receiving hole 91 through each of the side flanges 83 and 85. No anchor bolt receiving holes 91 are shown through the front mounting flange 89 since bolts in this location would be of limited utility in resisting the load torque due to the short lever arms that would exist between such holes 91 and the front edge 92.

The anchor bolt receiving holes 91 are each shown as including a respective slot that extends between the anchor-bolt receiving hole 91 and the nearest edge of the base plate 82. These slots are the result of flame-cutting the holes 91 and do not serve any function.

Each column base 15 further includes a pair of wheels 93 mounted rearwardly of a rear edge 95 of the base plate 82. Each wheel 93 rotates about a respective axle 96 and is captured between an inner wheel plate 97 that is fixed to and extends rearwardly from the rear wall 19 of the post 13 and an outer wheel plate 99 that is fixed to and extends rearwardly from the respective sidewall 20 or 21 of the post 13. Each of the wheel plates 97 and 99 is further fixed to the upper face of the base plate 82 such that the plates 97 and 99 further act as gussets to reinforce the connection between the column base 15 and the post 13.

The wheels 93 are positioned to rollingly engage a ground surface when the bottom surface of the base plate 82 is in abutment against the ground surface. Further, since the wheels are positioned rearwardly of the base plate 82, the respective lifting column 3 can be tilted rearwardly on the wheels 93 to bring the respective base plate 82 off of the ground surface, allowing the lifting column 3 to be rolled across the ground surface on the wheels 93.

Each lifting column 3 is provided with a handle 100 positionable near the top of the respective post 13 to facilitate tilting and rolling the lifting column 13. Each handle 100 generally comprises a bar 101 extending through aligned openings 102*a* in the sidewalls 20 and 21 near the top of the respective post 13. One end of the handle 100 is provided with a grip 103. When the lift 1 is in use, the handles 100 also serve as safety lock bars to prevent inadvertent lowering of the lifting carriages 17. In order to prevent the lifting carriages from being lowered or falling from their fully raised positions, the handles 100 may each be inserted with the respective bar 101 extending through openings 102*b* in the sidewalls 20 and 21, that are positioned immediately below the lifting carriages 17 when the lifting carriages 17 are in their fully raised position. Similarly, if the carriages 17 are only partly raised, the handles 100 may each be inserted with the respective bar 101 extending through openings 102*c* in the sidewalls 20 and 21, that are positioned immediately below the lifting carriages 17 when the lifting carriages 17 are approximately midway between their raised and lowered positions.

Hydraulic power for the lifting columns 3 is provided by the power unit 5 that is mounted on the cart 9. The power unit 5 includes a motor 105, such as an AC electric motor, that drives a hydraulic pump 107 that circulates hydraulic fluid from a reservoir 109. From the pump 107, fluid flows to the flow divider 7 that directs flow to the two lifting columns 3. The flow divider 7 is preferably a rotary gear flow divider adapted to provide synchronized movement of the two lifting columns 3 even if uneven weight acting on the lifting columns 3 results in unequally loaded hydraulic actuators 33. The cart 9 further includes wheels 111 and grips 113 for easy portability of the cart 9.

The flow divider 7 includes first and second quick disconnect fittings 115 and 117 each of that receives a first end of a respective one of the quick disconnect hoses 11. The second end of each hose 11 is connected to a respective quick disconnect fitting 119 located on the post 13 of a respective one of the lifting columns 3. The fittings 119 on the posts 13 are each connected to the cylinder 37 of the actuator 33 positioned inside the respective post 13.

In use, the lift 1 can be quickly and easily moved from storage to a working position. On initial installation of the lift 1, the lifting columns 3 (without the arms 18) are rolled into their desired positions on a concrete slab 120 using the wheels 93. Using a hammer drill or the like, holes 121 are drilled in the slab 120 in alignment with the anchor bolt receiving holes 91 in the column bases 15, and internally-threaded recessed anchors 123 are installed in the holes. Anchor bolts 125 are then installed through the anchor bolt receiving holes 91 and tightened into the anchors. As the anchor bolts 125 are tightened, the anchors 123 expand against the sides of the holes 121 and grip the concrete. The arms 18 are then installed on the crossbars 39 using the clevis pins 63. The power unit 5 mounted on the cart 9 is then rolled into position and connected to the lifting columns 3 using the quick disconnect hoses 11. The power unit 5 is then plugged in and the lift 1 is ready for use.

The lift 1 is easily removed from the work area for storage by disconnecting the power unit 5, removing the arms 18, and removing the anchor bolts attaching the lifting columns 3 to the slab. The cart 9 and lifting columns 3 can then be rolled to a storage location on their associated wheels 93 and 111. Because of the relatively small size of the column bases 15, minimal storage space is required. It should be noted that the anchors remain installed in the concrete slab, so that on the second and succeeding installation of the lift 1, no drilling is required. The lifting columns 3 are simply positioned over the existing holes in the slab, and the anchor bolts installed.

As disclosed herein, the lift 1 is well adapted as a medium rise lift having a lifting height of approximately 45 inches and a column height that increases from a minimum of 64 inches to a maximum of 89 inches as the carriages 17 and associated actuator cylinders 37 are raised. As such, the lift 1 is ideally suited for use in a residential garage or the like having a ceiling height as low as eight feet (96 inches).

As depicted in FIGS. 6-9, the lift 1 can employ a safety latching assembly 200 that prevents unintentional lowering of the lifting carriage 17 caused by, for example, equipment failure or operator error. The safety latching assembly 200 is preferably provided on both of the lifting columns but might only be provided on one of the columns. The safety latching assembly 200 includes a latching pawl 202, a control member 204, and a plurality of lock blocks 206. The latching pawl 202 is pivotably coupled along a side of the carriage base 27 between the carriage base 27 and one of the sidewalls 20, 21. The pawl 202 is a generally rectangular planar member comprised of plate steel but other configurations and materials can be used. A lower edge 208 of the pawl 202 extends at an angle, downward and rearward, and a generally triangular recess 210 is formed in a rear edge 212 adjacent to the lower edge 208 to form a finger 214 directed toward the rear wall 19 of the lift 1.

The pawl 202 is rotatably coupled to the carriage base 27 via a mounting stud 216 extending from the side of the carriage base 27. A C-clip 218 is installed on a distal end of the stud 216 to retain the pawl 202 in rotatable coupling about the stud 216.

A stop stud 220 extends from a side 217 of the pawl 202 and away from the carriage base 27. The stop stud 220 is generally centrally located along the length of the pawl 202 and is positioned adjacent and forward along the width of the pawl 202 from a mounting aperture # into which a pivot pin 222 is received. The mounting aperture may be threaded to threadably receive the pivot pin 222 or the pivot pin 222 might be welded or otherwise affixed in the mounting aperture.

A coil spring 224 is coupled between the rear edge 212 of the pawl 202 and the carriage base 27. The spring 224 biases the pawl 202 to rotate about the stud 216 such that the finger 214 is biased toward the rear wall 19 of the lift 1.

The control member 204 comprises a first arm 226 and a second arm 228 disposed at an acute angle to one another and joined together at their proximate ends to form a point 230. The first arm 226 extends from the point 230 a selected distance in the form of an elongate finger. A distal end of the first arm 226 may be rounded or angled to assist sliding movement of the lock blocks 206 thereby as described more fully below.

The second arm 228 extends to a distal end at which a lanyard 232 is coupled thereto. The lanyard 232 comprises any rope, wire, string, cable, or similar component useable to operate or move the control member 204 as described below. A free end of the lanyard 232 extends from between the carriage base 27 and the edge flange 25 outwardly from the lift 1 to enable an operator to grasp and pull the lanyard 232. The lanyard 232 might also be routed within the lift 1 to extend from the lift 1 through an aperture. A handle might also be disposed on the free end of the lanyard 232 to aid in pulling by the operator.

The second arm 228 includes an aperture or receiver formed therein and through which the pivot pin 222 can be inserted to rotatably couple the control member 204 to the pawl 202. A recess 234 is also formed in the second arm 228 between the aperture for the pivot pin 222 and the distal end of the arm 228. The recess 234 is configured to at least partially receive the stop stud 220 on the pawl 202 therein and to restrict rotation of the control member 204 about the pivot pin 222 so that it cannot rotate past the stop stud 220. In an embodiment, the second arm 228 contacts the stop stud 220 without the inclusion of a recess 234 thereon.

As depicted in FIGS. 6-9, the lock blocks 206 comprise rectangular blocks of material that are welded or otherwise affixed to or formed on an inner surface of the rear wall 19 of the lift 1 and aligned rearwardly from the pawl 202 and control member 204. The lock blocks 206 might alternatively comprise flanges, tabs, or other protuberances on the inner surface of the rear wall 19 or other interior surface of the lift 1. The lock blocks 206 are spaced at even intervals along the inner surface of the rear wall 19, e.g. every four inches, but can be evenly or unevenly spaced as desired. The lock blocks 206 can also have any desired thickness or standoff distance from the rear wall 19. Any number of lock blocks 206 can be provided; the greater number of lock blocks 206 increases the number of locking positions available.

Figure 6:
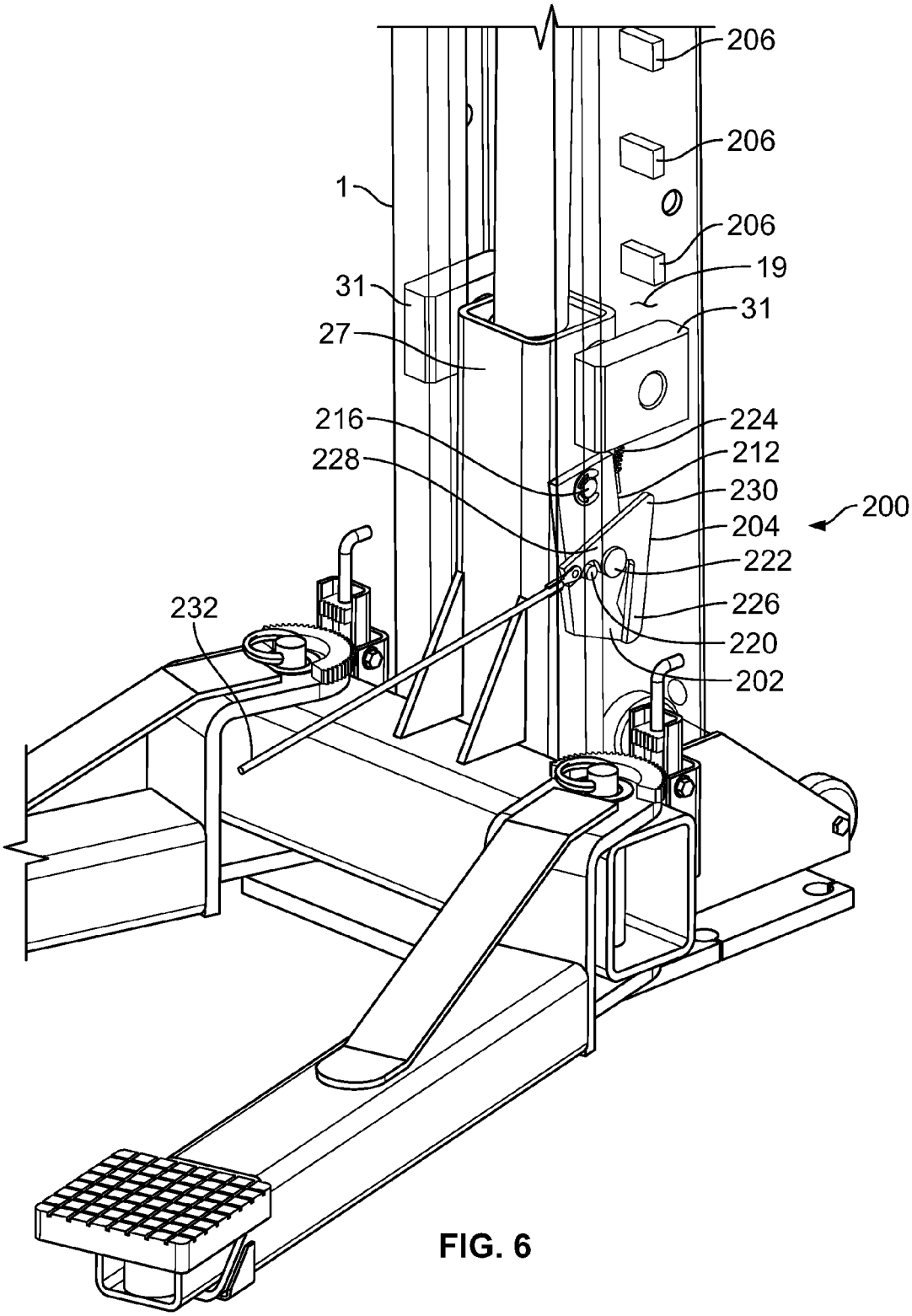
FIG. 6 is a perspective view of a lifting column of a two-post automobile lift with sidewalls thereof depicted transparently to display a safety latching assembly disposed therebehind in accordance with an embodiment of the invention.
Figure 7:
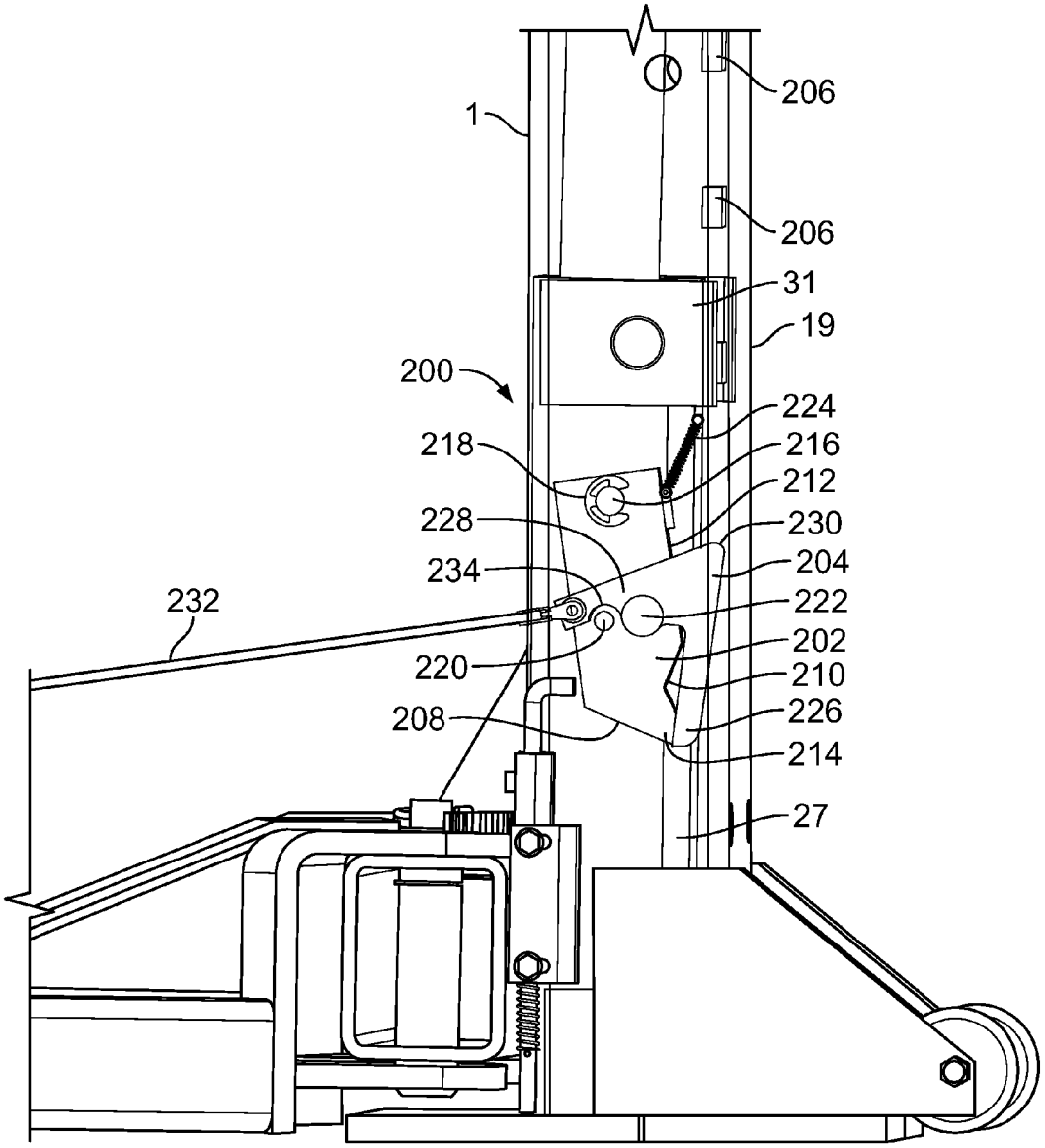
FIG. 7 is a side elevational view of the lifting column of FIG. 6 with the sidewall depicted transparently to show the safety latching assembly therein in a disengaged orientation in accordance with an embodiment of the invention.

With continued reference to FIGS. 6-9, operation of the safety latching assembly 200 is described in accordance with the embodiment of the invention shown. References to rotation of one or more of the components in a clockwise or counter-clockwise direction is made with respect to the components from the perspective shown in the drawings and is not intended to be limiting. As depicted in FIGS. 6 and 7, the safety latching assembly 200 is initially in a disengaged orientation and the lifting carriage 17 is in the lowered position.

In the disengaged orientation, the control member 204 is positioned about the pivot pin 222 with the second arm 228 rotated into contact with the stop stud 220. The stop stud 220 thereby prevents further counter-clockwise rotation of the control member 204. The point 230 of the control member 204 is biased against the rear wall 19 of the lift 1 by the spring 224 biasing or pulling the finger 214 of pawl 202 counter-clockwise about the stud 216 and toward the rear wall 19 of lift 1. The distance between the point 230 and the pivot pin 222 along the second arm 228 is sufficient to space the finger 214 of the pawl 202 forward from the rear wall 19 of the lift 1. The spacing between the finger 214 and the rear wall 19 is also sufficient to allow the lock blocks 206 to pass therebetween. The lanyard 232 is depicted extending from the front of the lift 1. The lanyard 232 need not be in tension.

As the carriage base 27 rises within the lift 1, the point 230 of the control member 204 slides along the rear wall 19 until contacting a bottom edge of a lock block 206. Contact with the lock block 206 while the carriage base 27 continues upward, rotates the control member 204 clockwise about the pivot pin 222 until the second arm 228 of the control member 204 is pivoted into a generally vertical orientation. The safety locking assembly 200 is thereby able to pass by the lock block 206. Rotation of the control member 204 may pivot the pawl 202 clockwise about the stud 216 to provide sufficient room for rotation of the point 230 about the pivot pin 222.

Figure 8:
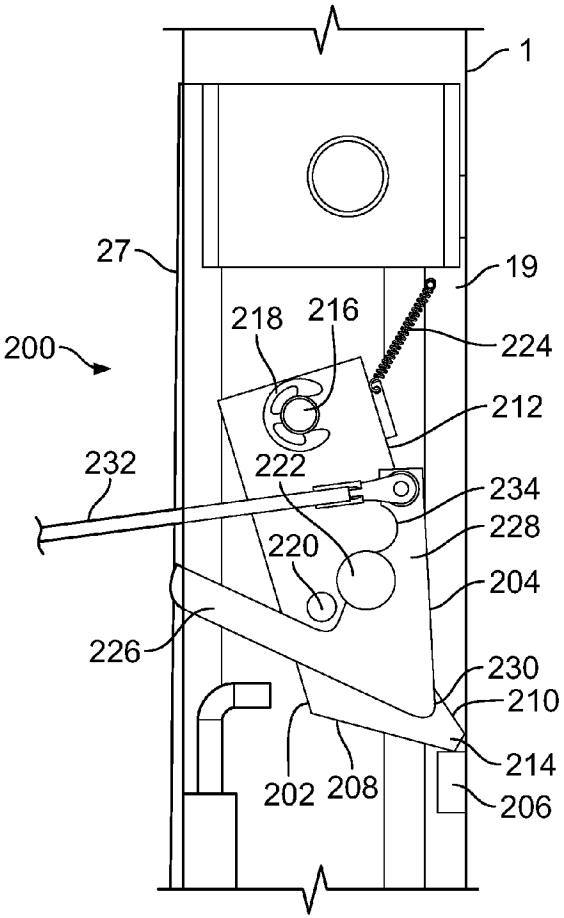
FIG. 8 is a side elevational view of the safety latching assembly of FIG. 7 depicted in a latched orientation in accordance with an embodiment of the invention.

Upon rotation of the point 230 past or vertically below the pivot pin 222, the spring 224 draws the pawl 202 counter-clockwise about the stud 216. This further rotates the control member 204 clockwise via contact between the point 230 and the rear wall 19 and brings the finger 214 of the pawl 202 into contact with the rear wall 19 and/or the lock block 206. When the finger 214 is vertically above the lock block 206 the pawl 202 fully rotates counter-clockwise, via the spring 224 bias, to contact the rear wall 19 and assume a locked position, as depicted in FIG. 8.

In the locked position, the finger 214 of the pawl 202 slides along the rear wall 19. During upward travel, the second arm 228 of the control arm 204 maintains the generally vertical alignment and is spaced apart from the rear wall 19 a sufficient distance to allow the lock blocks 206 to pass therebetween. In one embodiment, the lock blocks 206 contact the second arm 228 and at least partially force it away from the rear wall 19 causing a slight clockwise rotation of the pawl 202 about the stud 216. The distal end of the second arm 228 may be rounded or angled to aid passage of the lock blocks 206 thereby.

Also during upward travel, the lock blocks 206 contact the pawl 202 and cause the pawl 202 to rotate clockwise about the stud 216 to allow the lock blocks 206 to pass thereby. The upward and rearward facing surface of the pawl finger 214 formed by recess 210 aids in forward rotation of the pawl 202 via contact with the lock blocks 206. The recess 210 can be configured to receive the lock blocks 206 therein to maintain the finger 214 of the lock block 206 against the rear wall 19 until the lock block 206 contacts the upper surface of the finger 214. The upper surface of the finger 214 can provide a slope along which the lock block 206 can easily slide.

After passing the lock block 206 the finger 214 is biased to return to contact with the rear wall 19. As such, when the lifting carriage 17 is moved downwardly, either intentionally or unintentionally, the lock blocks 206 obstruct downward sliding movement of the finger 214 along the rear wall 19, as depicted in FIG. 8. The distance along the pawl 202 between the mounting stud 216 and the distal end of the finger 214 is greater than the distance between the stud 216 and the rear wall 19 of the lift 1. Thus, counter-clockwise rotation of the pawl 202 upon contact with the lock block 206 during downward movement is restricted; the pawl 202 is bound between the stud 216 and the rear wall 19 and/or lock block 206 such that the pawl 202 cannot rotate counter-clockwise and the lifting carriage 17 cannot move downward past the lock block 206. Downward movement of the lifting carriage 17 is thereby restricted by the safety locking assembly 200.

In an abrupt engagement of the safety locking assembly 200, such as during an unintended lowering or falling of the lifting carriage 12, the recess 210 may allow the finger 214 to deform toward the recess 210 while maintaining engagement with the lock block 206. This may aid to reduce stresses on the stud 216 to avoid breakage thereof during a high stress engagement of the assembly 200.

To lower the lifting carriage 17 the safety locking assembly 200 is first disengaged. The operator pulls on the lanyard 232 to rotate the control member 204 from the orientation depicted in FIG. 8 to the orientation depicted in FIGS. 6-7 and 9. Pulling on the lanyard 232 rotates the control member 204 counter-clockwise about the pivot pin 222. The rotation moves the point 230 of the control member 204 against and along the rear wall 19 to a position vertically above the pivot pin 222 and moves the second arm 228 into contact or into close proximity with the stop stud 220. Due to the distance between the pivot pin 222 and the point 230 along the second arm 228, the pawl 202 is pivoted clockwise about the stud 216, away from the rear wall 19, and out of engagement with the stop blocks 206. The location of the pivot pin 222 and the point 230 are offset along the width of the second arm 228 such that a lever arm is formed about the pivot pin 222 by the point 230. This lever arm and the spring bias rotating the pawl 202 counter-clockwise maintain the control member 204 in the disengaged orientation during downward movement of the lifting carriage 17. As such, after disengaging the safety locking assembly 200, the lanyard 232 need not be pulled in tension during lowering of the lifting carriage 17, e.g. the lanyard 232 can be pulled to rotate the control member 204 to the disengaged orientation and then released.

Figure 9:
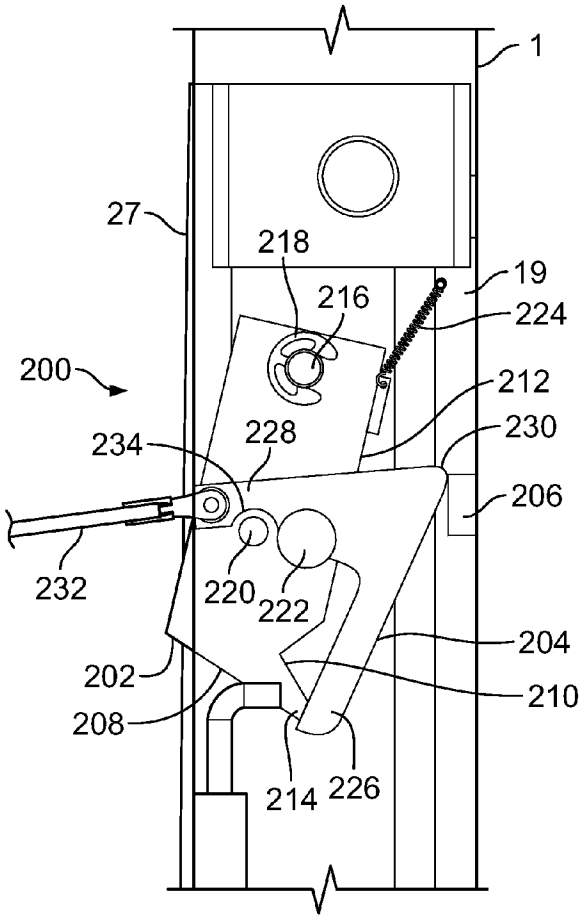
FIG. 9 is a side elevational view of the safety latching assembly of FIG. 7 depicted in the disengaged orientation and slideably passing a lock block in accordance with an embodiment of the invention.

As depicted in FIG. 9, the first arm 226 of the control member 204 provides a sliding surface along which the lock blocks 206 can slide during downward movement of the lifting carriage 17. Sliding of the lock blocks 206 between the first arm 226 and the rear wall 19 forces the control arm 204 away from the rear wall and thus causes the pawl 202 to rotate clockwise about the stud 216. The lock blocks 206 may also apply an upward force on the first arm 226 as they slide by that attempts to rotate the control member 204 counter-clockwise about the pivot pin 222. Such rotation is obstructed by the stop stud 220 contacting the second arm 228 and works to maintain the control member 204 in the disengaged orientation.

It is to be understood that while certain forms of the present invention have been illustrated and described herein, it is not to be limited to the specific forms or arrangement of parts described and shown. For example, it is to be understood that although the base plate 82 of the column base 15 is shown and described herein as being generally square, it is to be understood that the plate 82 could be of virtually any geometric shape, including other polygonal shapes as well as circular, ovoid or elliptical shapes.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. A lifting column comprising a first of a pair of lifting columns for an automobile lift, said first lifting column including:

a post including a plurality of lock blocks disposed along an interior surface and aligned along the length of the post;

a column base comprising a base plate connected to a lower end of the post; said base plate having at least one edge spaced outwardly from a respective wall of said post to form a first mounting flange, said first mounting flange having at least one anchor bolt receiving hole extending therethrough, said column base further including a pair of wheels positioned to engage a ground surface rearward of said base plate;

a lifting carriage moveably mounted on a forward inward side of the post;

at least one lifting arm extending outwardly from the lifting carriage having a length sufficient to engage an undercarriage of a vehicle positioned between the inward sides of the lifting columns and being pivotable side-to-side about a coupling with the lifting carriage, a safety locking assembly pivotably mounted on the lifting carriage and including a pawl and a control member, the pawl in a locking orientation engaging one of the plurality of lock blocks on the post to restrict downward movement of the lifting carriage, and in a disengaged orientation being spaced apart from the lock blocks by the control member to enable downward movement of the lifting carriage; the control member including a first arm and a second arm meeting at an angle to form a point, the point contacting one of the plurality of lock blocks during upward movement to automatically enable the locking orientation of the pawl, and wherein the control member is rotatably coupled to the pawl along the second arm and the first and second arms meet at an acute angle and a hydraulic actuator connected to the lifting carriage for movement of the lifting carriage along the post.

2. The portable automobile lift as in claim 1, wherein said first lifting column further comprises:

at least one pair of aligned lock bar securement holes formed through the opposed sidewalls of the post;

a pair of aligned lock bar storage holes extending through the sidewalls of the post proximate an upper end thereof; and a lock bar insertable through the at least one pair of aligned lock bar securement holes for preventing the carriage from dropping therebelow, the lock bar having a length that is sufficient to provide a portion of each end of the lock bar sized to be gripped by a user's hand extending past the opposed sidewalls of the post when the lock bar is positioned through the pair of aligned lock bar storage holes, the pair of aligned lock bar storage holes being positioned at a height to facilitate grasping of the lock bar when positioned therein for tilting the lift onto a pair of wheels and for maneuvering the lift on the wheels.

3. The lift as in claim 2, wherein the lock bar has a grip on an end thereof.

4. The first lifting column as in claim 1, wherein the control member is rotatable to move the pawl to the disengaged orientation with the point of the control member against a rear wall of the post, the second arm of the control member having a length between the point and a coupling with the pawl sufficient to move the pawl away from the rear wall of the post a distance greater than a standoff distance of the lock blocks from the rear wall.

5. The first lifting column as in claim 4, wherein a lanyard is coupled to the distal end of the second arm and is pulled to rotate the control member to the disengaged position.

6. The first lifting column as in claim 1, wherein the lifting arm includes a rack having a plurality of teeth disposed proximate the lifting carriage; the first lifting column further including a latching member disposed on the lifting carriage and having at least one locking tooth configured to engage the teeth of the rack to selectively restrict pivotal movement of the lifting arm; wherein the latching member includes an elongate body with the at least one locking tooth disposed along at least a portion of a side thereof, and wherein the latching member is moveable along a long axis of the elongate body to disengage the at least one locking tooth from the rack to enable pivotable movement of the lifting arm.

7. The first lifting column as in claim 6, wherein the latching member is biased toward engagement of the locking tooth with the rack.

8. The first lifting column as in claim 7, wherein in a lowered position of the lifting carriage, the latching member contacts the column base and is moved along the long axis of the elongate body with respect to the lifting carriage to disengage the at least one locking tooth from the rack to automatically enable pivotable movement of the lifting arm in the lowered position.

9. A lifting column for an automobile lift comprising a post;

a lifting carriage moveably mounted on the post;

a plurality of lock blocks disposed along an interior surface of the post and aligned along the length of the post;

a pawl pivotably mounted to the lifting carriage and moveable between a locking orientation engaging one of the plurality of lock blocks to restrict downward movement of the lifting carriage and a disengaged orientation spaced apart from the lock blocks; and a control member rotatably coupled to the pawl and including a first arm and a second arm meeting at an acute angle to form a point, the point contacting one of the plurality of lock blocks during upward movement of the lifting carriage to automatically enable the locking orientation of the pawl.

10. The lifting column as in claim 9, wherein the control member is rotatable to move the pawl to the disengaged orientation with the point of the control member against a rear wall of the post, the second arm of the control member having a length between the point and a coupling with the pawl sufficient to move the pawl away from the rear wall of the post a distance greater than a standoff distance of the lock blocks from the rear wall.

11. The lifting column as in claim 9 wherein the pawl is biased toward the locking orientation by a spring.

12. The lifting column as in claim 9, wherein a lanyard is coupled to the distal end of the second arm and is pulled to rotate the control member to the disengaged position.

* * * * *